United States Patent [19]

O'Shea

[11] 3,942,940

[45] Mar. 9, 1976

[54] VOTIVE CANDLE AND CONTAINER AND ARRAY THEREOF

[76] Inventor: William J. O'Shea, 211 Lafayette Road, Nob Hill III, Syracuse, N.Y. 13205

[22] Filed: Jan. 13, 1975

[21] Appl. No.: 540,498

Related U.S. Application Data

[63] Continuation of Ser. No. 387,127, Aug. 9, 1973, abandoned.

[52] U.S. Cl. ..... 431/291; 431/295; 240/10 B

[51] Int. Cl.[2] ..... F23D 3/16

[58] Field of Search ..... 431/289, 291, 295; 240/10 B

[56] References Cited

UNITED STATES PATENTS

| | | | |
|---|---|---|---|
| 2,001,312 | 5/1935 | O'Connell | 431/291 |
| 2,530,288 | 11/1950 | Ciano | 431/295 |
| D56,059 | 8/1920 | Flannery | D48/2 |

*Primary Examiner*—Carroll B. Dority, Jr.
*Attorney, Agent, or Firm*—Charles S. McGuire

[57] ABSTRACT

A votive light including an opaque, metal container as the sole enclosure for a candle. Cut-outs are provided in the container well through which light from the candle is projected. The lowest edge of the cut-outs is higher than the initial height of the candles when resting on the bottom well of the container. The metal containers are arranged on shelves in horizontal rows of ascending height. The cut-outs are at a vertical height above the bottom of the container substantially equal to the difference in height of each row of candles. The size and spacing of the cut-outs relative to that of the containers is such that light from the candles passes through the openings and is reflected from adjacent containers.

3 Claims, 4 Drawing Figures

VOTIVE CANDLE AND CONTAINER AND ARRAY THEREOF

REFERENCE TO RELATED APPLICATION

This is a continuation of application Ser. No. 387,127 of the same inventor filed Aug. 9, 1973, now abandoned.

BACKGROUND OF THE INVENTION

Candles have been used as religious symbols in churches for many hundreds of years. An array of such candles is commonly provided in many churches which may include several hundred candles in closely spaced relation.

For esthetic purposes, the visual effect of the illumination provided by the candles should be enhanced as much as possible. At the same time, some provision must be made for protecting against the fire hazard inherent in the open flames. For this reason, each candle is commonly held in an individual container which prevents run-off of hot wax and protects the underlying support and any nearby articles from the flame.

Containers providing the best compromise between the esthetic desirability of a visible flame and the safety requirement of an enclosed flame have been glass containers. These may be provided in various colors and varying degrees of transparency to offer the desired appearance. However, such containers are subject to breakage from impact or the heat generated by the candle flame. Thus, although glass containers do provide the necessary flame and heat containment as long as they remain intact, a definite safety hazard is presented by their susceptibility to breakage. The glass containers become extremely brittle after several hours of exposure to heat and carbon deposits from burning candles. In addition to the safety hazard, breakage of the containers presents maintenance problems (i.e., cleaning up the broken glass, wax, etc.) and adds significantly to upkeep costs both in providing the necessary maintenance services and in buying replacement containers. While containers made of materials other than glass have been provided, the esthetic requirement of a visible flame or illumination has made opaque containers entirely unsuited to such applications.

SUMMARY OF THE INVENTION

The present invention is directed to, and has as a principal object the provision of a votive light comprising a candle in an unbreakable container which still achieves the desired esthetic effect.

A further object is to provide an array of candles, each in an individual container, which represents a better combination of safety and esthetic effect than prior art arrays of such candles.

The individual containers are constructed entirely of metal, such as aluminum, and are therefore not subject to breakage from heat or impact as a glass container would be. A plurality of openings or cut-outs in the container side wall are provided for passage of light from the candle. The lowest edge of the cut-outs is higher than the initial height of the candles, whereby the containers may form the sole enclosure. The position of the cut-outs in the respective containers, and the relative positions of the containers within the array, is such at a most satisfactory esthetic effect is achieved by reflection of illumination from one candle from the surfaces of adjacent containers in the array.

DESCRIPTION OF THE PREFERRED EMBODIMENT

Figure 1:
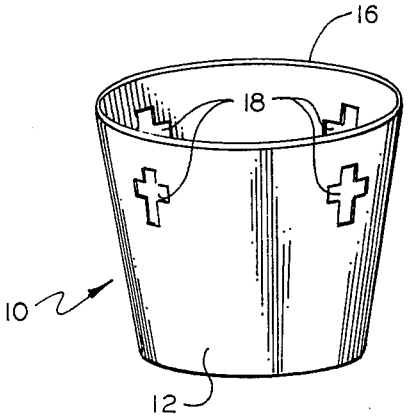
FIG. 1 is a perspective view of a preferred embodiment of container for use in the invention.

Referring now to the drawing, in FIG. 1 is shown a preferred embodiment of container formed entirely of metal, e.g., aluminum, and designated generally by reference numeral 10. The metal may be cast, spun, or formed by any convenient technique, to provide containers 10 with generally cylindrical side wall 12, diverging from flat, bottom wall 14 (FIG. 2) to an open upper end defined by edge 16. Both the inside and outside surface of at least the side wall is light reflecting.

A plurality of openings or cut-outs 18 are provided in side wall 12. Preferably, four such cutouts are provided at 90° intervals around the side wall, and may be in the form of a cross, as shown, or other religious symbol since the intended use is in connection with religious observance. The lower edge of each of cut-outs 18 is a distance d above the bottom of container 10, and the cut-outs have a height h.

Figure 2:
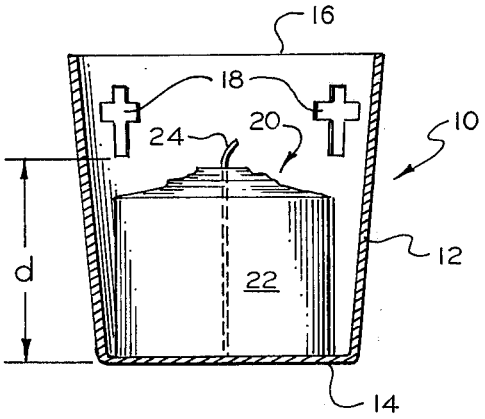
FIG. 2 is an elevational view of a candle within the container of FIG. 1, the container being shown in vertical cross-section.

Votive candle 20 is shown in FIG. 2 placed within container 10. Candle 20 is of a type in wide commercial use, comprising the usual wax body 22 and centrally disposed wick 24. The initial height of candle 20 is normally not greater than distance d, candle 20 having a constant diameter approximately equal to, or slightly smaller than, that of bottom wall 14 of the container. Thus, melted wax may run down the sides of the candle within the container, and will not under normal conditions flow out of cut-outs 18.

Figure 3:
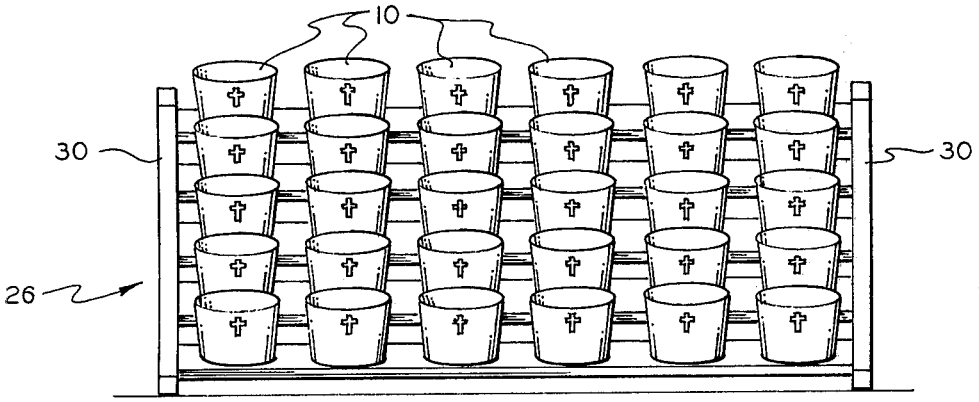
FIG. 3 is a front view of an array of containers and candles of the type shown in FIG. 2 on a supporting stand.
Figure 4:
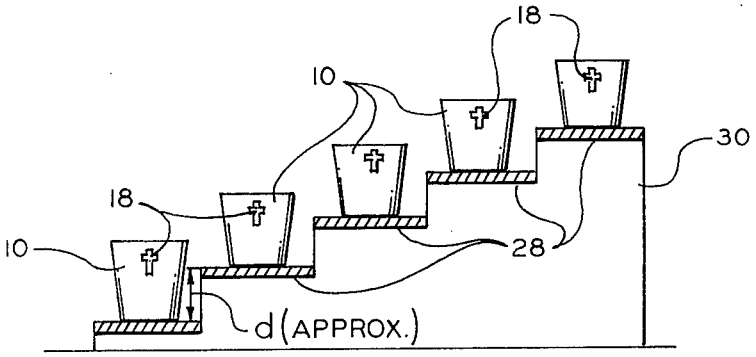
FIG. 4 is an end elevation of the array shown in FIG. 3.

In FIGS. 3 and 4 a plurality of containers 10, each holding a candle 20, are arranged in horizontal rows of ascending height. Supporting stand 26 is constructed in conventional manner to include horizontally disposed shelves 28 attached at each end to supports 30. Each of shelves 28 is preferably at least as wide as the diameter of bottom wall 14 and each successive shelf is spaced laterally by a distance somewhat greater than the diameter of upper edge 16 and vertically by a distance substantially equal to distance *d.*

It may be seen from FIGS. 3 and 4 that illumination from the candles within containers 10 will pass through cut-outs 18 and either be directly visible or be reflected from one or more adjacent containers. Each of the containers is arranged on support stand 26 with one of openings 18 facing the front (the lowest shelf), whereby two of the openings will face the adjacent containers on each side, and the other opening will face the rearwardly adjacent container on the next higher shelf. Since each successive shelf is vertically spaced by substantially the same vertical spacing as that from the bottom of containers 10 to cut-outs 18, a major portion of each row of containers will be visible from the front, and a maximum amount of the light passing through the rearwardly fading cut-out will be reflected from the rearwardly adjacent container throughout the burning of the candles. The light from the candle flame will be reflected from the inside of side wall 12 to pass through cut-outs 18 at a maximum angle regardless of the height of the candle, and will be reflected from the outer surface of each laterally and rearwardly adjacent container so that each container appears brightly illuminated with a pleasing esthetic effect notwithstanding the opacity of the containers.

What is claimed is:

1. A votive candle array comprising:

a. a plurality of candles initially of a predetermined first height;

b. a plurality of opaque, metal containers, each containing one of said candles and having a flat bottom wall upon which said candle rests, a generally cylindrical side wall, both the inner and outer surfaces of which are light reflective, and an open top, said containers providing the sole enclosures for said candles;

c. four cut-outs are provided in each container side wall at 90° intervals, said cut-outs each extending upwardly from a lower edge a predetermined second height, greater than said first height, above said bottom wall, said side wall being solid and continuous from said lower edge to said bottom wall.

d. a support stand having a plurality of horizontally disposed shelves, each successive shelf being spaced laterally from the forwardly adjacent shelf, and vertically therefrom by a distance substantially equal to said second height; and e. said containers, with said candles therein, being arranged in side-by-side relation on each of said shelves, and substantially in alignment with the containers on the next succeeding shelf with two of said cut-outs facing the two laterally adjacent containers and one cut-out facing a rearwardly adjacent container, whereby light passing through said cut-outs is reflected from the outer surface of the laterally and rearwardly adjacent containers.

2. The invention according to claim 1 wherein said second height is greater than one-half the total height of said containers.

3. The invention according to claim 2 wherein each of said shelves are laterally spaced, center-to-center, from adjacent shelves by at least the diameter of said open upper end of said containers.

* * * * *